US005180914A

United States Patent [19]

Davis et al.

[11] Patent Number: 5,180,914

[45] Date of Patent: Jan. 19, 1993

[54] MASS SPECTROMETRY SYSTEMS

[75] Inventors: Stephen C. Davis, Fen Ditton; Sydney Evans, Sale, both of England

[73] Assignee: Kratos Analytical Limited, Manchester, England

[21] Appl. No.: 696,606

[22] Filed: May 7, 1991

[30] Foreign Application Priority Data

May 11, 1990 [GB] United Kingdom ..... 9010619

[51] Int. Cl.[5] ..... H01J 49/40

[52] U.S. Cl. ..... 250/287; 250/286; 250/292

[58] Field of Search ..... 250/287, 292, 286, 281, 250/282, 283, 290, 293

[56] References Cited

U.S. PATENT DOCUMENTS

| | | | |
|---|---|---|---|
| 2,780,728 | 2/1957 | Langmuir | 250/287 |
| 2,790,080 | 4/1957 | Wells | 250/287 |
| 2,839,687 | 6/1958 | Wiley | 250/287 |
| 2,957,985 | 10/1960 | Brubaker | 250/287 |
| 3,576,992 | 5/1971 | Moorman | 250/287 |
| 3,582,648 | 6/1971 | Anderson | 250/287 |
| 3,727,047 | 4/1973 | Janes | 250/287 |
| 3,767,914 | 10/1973 | Mueller et al. | 250/287 |
| 3,953,732 | 5/1976 | Oron et al. | 250/287 |
| 4,072,862 | 2/1978 | Mamyrin et al. | 250/287 |
| 4,754,135 | 6/1988 | Jackson | 250/287 |
| 5,032,722 | 7/1991 | Boesl et al. | 250/287 |
| 5,073,713 | 12/1991 | Smith et al. | 250/287 |
| 5,077,472 | 12/1991 | Davis | 250/287 |
| 5,120,958 | 6/1992 | Davis | 250/287 |

FOREIGN PATENT DOCUMENTS

| | | |
|---|---|---|
| WO83/00258 | 1/1983 | PCT Int'l Appl. . |
| 756623 | 9/1956 | United Kingdom . |
| 1302193 | 1/1973 | United Kingdom . |
| 1326279 | 8/1973 | United Kingdom . |
| 2153139 | 8/1985 | United Kingdom . |

OTHER PUBLICATIONS

Patent Abstracts of Japan, vol. 10, No. 255, E-433 (2311).

International Journal of Mass Spectrometry and Ion Processes vol. 93, No. 3 Oct. 30, 1989 Amsterdam NL pp. 323-330.

Soviet Patent Abstracts Week 8625 Jul. 4, 1986.

Patent Abstracts of Japan vol. 12 No. 189 (E-616) (3036).

*Primary Examiner*—Jack I. Berman
*Assistant Examiner*—Kiet T. Nguyen
*Attorney, Agent, or Firm*—Leydig, Voit & Mayer

[57] ABSTRACT

A mass spectrometry system comprises a source of ions for analysis, an ion storage device for separating the source ions as a function of their different mass-to-charge ratios, means for dissociating the separated source ions in order to generate daughter ions and an ion mirror for analyzing the daughter ions as a function of the mass-to-charge ratios. The mass spectrometry system has particular utility in the analysis of large molecules contained in biological and biochemical samples.

22 Claims, 5 Drawing Sheets

MASS SPECTROMETRY SYSTEMS

BACKGROUND OF THE INVENTION

This invention relates to mass spectrometry systems.

There has been an increasing need over recent years to provide mass spectrometry systems capable of analysing samples with improved sensitivity.

This is particularly important if the mass spectrometry system is to be used to analyse the structures of large molecules, contained in biological and biochemical samples, for example. Such samples may only be available in relatively small volumes and the samples may be delivered to the mass spectrometry system, for analysis, over a relatively short time scale (typically a few seconds) using a conventional inlet system, such as a liquid chromatograph, for example. Many existing mass spectrometry systems do not have the capability to process small sample volumes with the required sensitivity.

SUMMARY OF THE INVENTION

According to the invention there is provided a mass spectrometry system comprising a source of ions for analysis, a first time-of-flight means for separating the source ions according to their mass-to-charge ratios, and a second time-of-flight means for analysing the mass-to-charge ratios of source ions which exit the first time-of-flight means and/or daughter ions derived from such source ions.

The system may comprise means for dissociating separated source ions having a selected mass-to-charge ratio whereby to generate said daughter ions.

In a preferred embodiment, the first time-of-flight device is an ion storage device and this preferably comprises field generating means for subjecting the source ions to an electrostatic retarding field during an initial part only of a preset time interval, the electrostatic retarding field having a spatial variation such that source ions which have the same mass-to-charge ratio and enter the ion storage device during said initial part of the preset time interval are all brought to a time focus during the remaining part of that preset time interval.

It has been found that a mass spectrometry system incorporating such an ion storage device can attain a high duty cycle leading to improved sensitivity.

The second time-of-flight means is preferably an ion mirror and the ion mirror may subject ions to an electrostatic reflecting field in the form of an electrostatic quadrupole field whereby the flight time of each ion through the ion mirror depends on the mass-to-charge ratio of that ion and is independent of the energy of the ion. The ion mirror may comprise a monopole electrode structure operating at a d.c. voltage.

BRIEF DESCRIPTION OF THE DRAWINGS

Mass spectrometry systems in accordance with the invention are now described, by way of example only, with reference to the accompanying drawings in which:

FIG. 3(*b*) shows a transverse cross-sectional view through another electrode structure used to generate the electrostatic retarding field;

FIG. 7(*b*) shows the equipotential lines generated by the monopole electrode structure of FIG. 7(*a*);

FIG. 7(*c*) shows a side elevational view of a side wall of a monopole electrode structure;

FIG. 8(*b*) shows a side elevational view of a side wall of the monopole electrode structure of FIG. 8(*a*).

DESCRIPTION OF PREFERRED EMBODIMENTS

The mass spectrometry system to be described is used to analyse the mass spectrum of daughter ions derived by dissociating parent ions having a selected mass-to-charge ratio.

Figure 1:
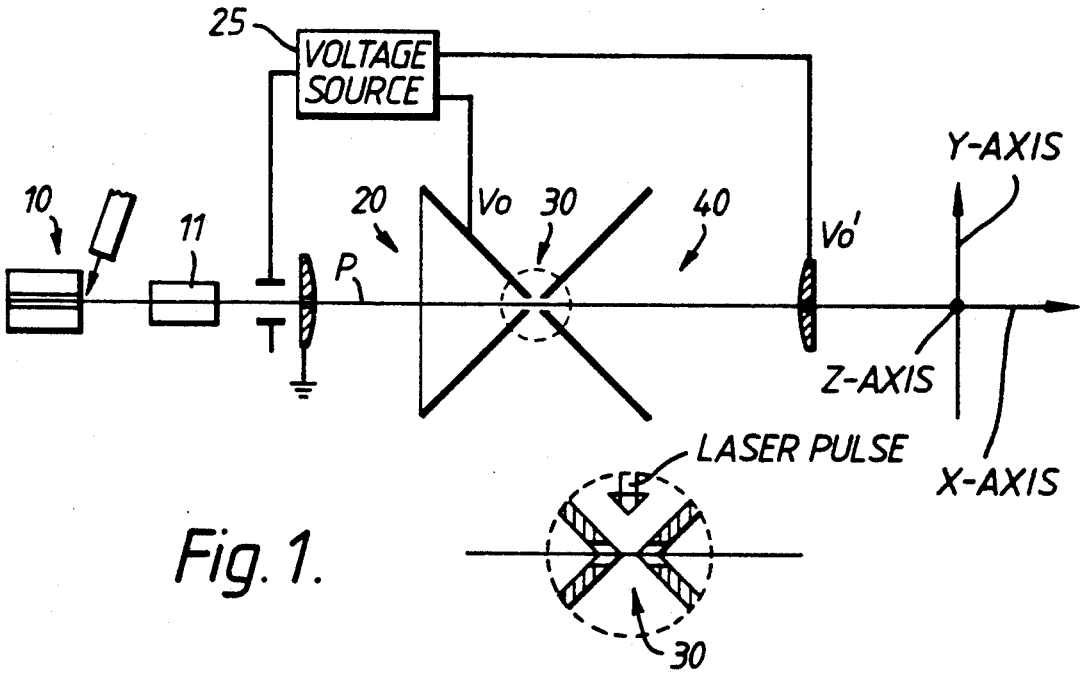
FIG. 1 is a diagrammatic illustration of a mass spectrometry system according to the invention.

Referring to FIG. 1 of the drawings, the mass spectrometry system comprises the serial arrangement of an ion source 10, a first time-of-flight device 20 for separating the source ions according to their different mass-to-charge ratios, a dissociation region 30, in which those parent ions having the selected mass-to-charge ratio are dissociated, and a second time-of-flight device 40 for analysing the mass spectrum of daughter ions derived, by dissociation, from the mass-selected parent ions.

In the described embodiment, the ion source 10 operates in continuous mode and may be of conventional form; for example electron impact, thermospray, electrospray and fast atom bombardment sources could be used, and such sources may have conventional inlet systems employed, for example, in liquid or gas chromatography mass spectrometry or in other continuous flow systems. Alternatively, the ion source may produce ion pulses of relatively long duration so that the ion beam is only generated during each successive ion storage period. It is also envisaged that ion pulses of shorter duration could be generated, using laser or ion beam excitation.

Ions produced by the ion source 10 are constrained by suitable extraction electrodes and source optics (shown diagrammatically at 11 in FIG. 1) to follow a path P through the first time-of-flight device 20, the ion beam being focussed at the exit aperture of the device.

As will be described in greater detail hereafter, the first time-of-flight device 20 comprises an ion storage device (alternatively termed an ion buncher). This device separates the received ions in accordance with their different mass-to-charge ratios and has the effect of bringing ions having the same mass-to-charge ratio to a time focus.

As will become apparent, the duty cycle that can be achieved by device 20 is much higher than that attainable by hitherto known systems using continuous ion beams and this leads to a greatly improved sensitivity which is particularly important when small sample volumes are being processed.

Ions exiting the first time-of-flight device 20 pass through the dissociation region 30 before entering the second time-of-flight device 40. It is convenient to use a laser pulse (of UV radiation for example), to dissociate the ions. Since ions having a desired, preselected mass-to-charge ratio will be well defined in both time and space, the laser pulse can be synchronised to coincide with their arrival in the dissociation region. It is envisaged, however, that other forms of dissociation (e.g. a gas collision cell) could alternatively be used.

The resulting daughter ions, produced by dissociation, enter the second time-of-flight device 40 together with any undissociated parent ions. The parent ions will have a substantial energy spread due to the action of bunching in the ion storage device. The daughter ions will also have a substantial energy spread; this is because the parent ions and their daughters have a range of different masses and so each daughter ion of mass $M_D$, say, will only have a fraction $M_D/M_P$ of the energy of the parent ion, of mass $M_P$, say, from which it is derived. However, as will be explained in greater detail hereinafter, the second time-of-flight device 40 of this embodiment uses an ion mirror which enables a high mass resolving power to be attained even though the ions introduced into its flight path, for analysis, have a range of different energies.

Typically, the flight paths of the first and second time-of-flight devices 20,40 would be of the order of 0.5–1.0 meters in length, whereas that of the dissociation region 30 would be of the order of a few millimeters—the latter is therefore shown on an enlarged scale in FIG. 1.

The mass spectrometry system will now be described in greater detail.

Figure 2:
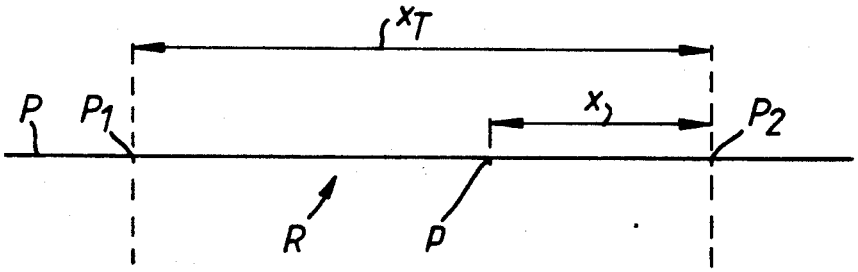
FIG. 2 illustrates a defined region in an ion storage device used in the system of FIG. 1.

FIG. 2 gives a schematic illustration of how the first time-of-flight device 20 operates. As explained, the first time-of-flight device is in the form of an ion storage device. Ions travel through the device along a path P, extending along the longitudinal X-axis (see FIG. 1), and an electrostatic field generator subjects ions occupying a defined region R of the path to an electrostatic retarding field.

As is shown schematically in FIG. 2, ions enter the region R at a position $P_1$ on path P and they exit the region at a position $P_2$, having travelled a distance $x_T$ along the path.

In operation, the field generator of the ion store is energised during an initial part only of a preset time interval (referred to hereinafter as the 'ion-storage' period) and is de-energised during the remaining part of that time interval (referred to hereinafter as the 'listening' period). The field generator may be energised and de-energised alternately, and ions which enter the defined region R, during a respective ion-storage period, will exit the region during the immediately succeeding listening period.

Ions entering region R are slowed down progressively by the electrostatic retarding field as they penetrate deeper into the region and accumulate in the region during the respective ion-storage period.

The electrostatic retarding field applied to ions in region R is such that the velocity v of an ion, moving along path P during a respective ion-storage period, is related linearly to its separation x from the exit position $P_2$.

More specifically, the velocity v of the ion during that period can be expressed as $$v = k\left(\frac{q}{m}\right)^{\frac{1}{2}}\left(\frac{x}{x_T}\right) \tag{1}$$

where m is the mass of the ion, q is its charge, and k is a constant.

Thus, for example, if an ion enters region R with an initial velocity $v_1$, its velocity at the mid-position ($x=\frac{1}{2}x_T$) in the region would be $\frac{1}{2}v_1$ and its velocity at the position $x=\frac{1}{4}x_T$ would be $\frac{1}{4}v_1$. Clearly, as the ion penetrates deeper into the defined region R its velocity is reduced in proportion to the distance it has travelled.

An ion entering region R during an ion-storage period continues to travel towards the exit position $P_2$ during the subsequent listening period, after the field generator has been de-energised. As will be clear from equation 1 above, ions having the same mass-to-charge ratio will all arrive at the exit position $P_2$ at the same time, regardless of their respective positions in region R at the instant the field generator is de-energised. For example, the distance from the exit position of an ion at the mid-position is half that of an ion at the entry position $P_1$; however, the velocity of the latter is twice that of the former. Accordingly, ions having the same mass-to-charge ratio are all caused to bunch together at the exit position $P_2$ at a particular instant in time, and ions having different mass-to-charge ratios will arrive at the exit position $P_2$ at different respective times, enabling them to be distinguished in terms of their different mass-to-charge ratios.

In this way, ions having the same mass-to-charge ratio are all brought to a time focus at the exit position $P_2$.

The condition set forth in equation 1 above will be satisfied if the retarding voltage V at any position x along the path P is given by the expression, $$V = \left\{1 - \left(\frac{x}{x_T}\right)^2\right\}V_o, \tag{2}$$

where $V_o$ is the retarding voltage applied across the defined region R. If $V_o$ is equal to the accelerating voltage; that is, the voltage applied to the ion source, the kinetic energy of an ion at a point x will be $$Q\left\{V_o - \left[1 - \left(\frac{x}{x_T}\right)^2\right]V_o\right\} = qV_o\left(\frac{x}{x_T}\right)^2, \tag{3}$$

and it can be seen from equation 3 that the velocity v of the ion will be $$v = \left\{\frac{2qV_o}{m}\left(\frac{x}{x_T}\right)^2\right\}^{\frac{1}{2}},$$

$$= \left(\frac{2qV_o}{m}\right)^{\frac{1}{2}}\frac{x}{x_T},$$

as required by equation 1 above.

Alternatively, it is possible to use a retarding voltage which is slightly larger or smaller than the accelerating voltage, and the effect of this is to shift the time focal point for the ions to a position respectively upstream or downstream of the position $P_2$ shown in FIG. 2, although the focussing effect would not be quite so good.

A preferred electrostatic retarding field for the ion storage device 20 is an electrostatic quadrupole field.

Adopting a Cartesian co-ordinate system, the distribution of electrostatic potential V(x,y,z) in an electrostatic quadrupole field can be expressed generally as $$V = \frac{V_o}{r_o^2}(2x^2 - y^2 - z^2), \quad (4)$$

where $r_o$ is a constant and $V_o$ is the applied potential.

A region of the electrostatic quadrupole field can be generated using an electrode structure having rotational symmetry about the longitudinal X-axis, and an electrode structure such as this is preferred because it has a focussing effect on the ions in the Y-Z plane.

Such rotationally symmetric electrode structures will be referred to hereinafter as "three-dimensional" electrode structures, and other electrode structures described herein, which do not have rotational symmetry, will be referred to as "two-dimensional" electrode structures.

An example of a "three-dimensional" electrode structure consists of two electrodes whose shapes conform to the respective equipotential surfaces at the potential $V_o$ and at earth potential. The electrode at the potential $V_o$ would have a hyperboloid surface generated by rotating the hyperbola $2x^2 - y^2 = r^2_o$ (in the X-Y plane) about the X-axis, and the earthed electrode would have a conical electrode surface, with the apex at the origin, generated by rotating the lines $$x = y/\sqrt{2} \text{ (for } y > o) \text{ and } x = y/\sqrt{2} \text{ (for } y < o)$$

about the X-axis. The potential at different co-ordinate Positions between these two electrode surfaces satisfies equation 4 above.

Figure 3A:
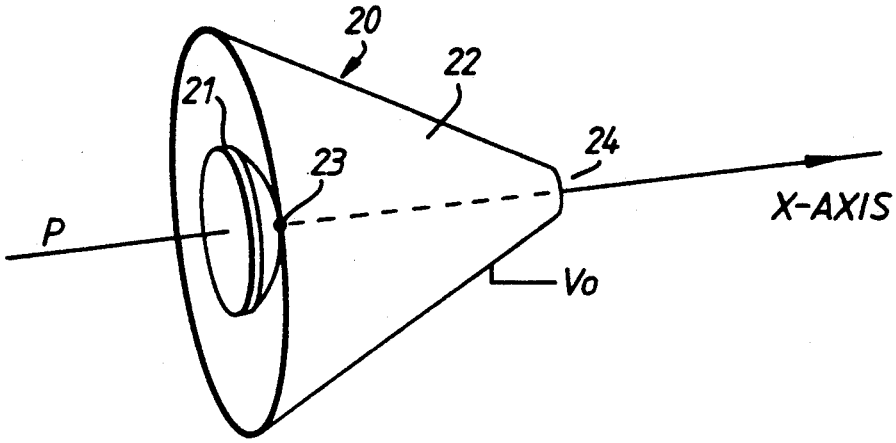
FIG. 3(*a*) shows a perspective view of an electrode structure used to generate the electrostatic retarding field in the ion storage device of FIG. 1.

Referring now to FIG. 3*a*, which shows a "three-dimensional" electrode structure for use in the ion storage device, the potentials on the two electrodes are, in fact, reversed so that the hyperboloid electrode (referenced 21 in FIG. 3*a*) is at earth potential and the conical electrode (referenced 22) is at the potential $V_o$. Ions enter the device through an entrance aperture 23 in the hyperboloid electrode 21, travel along the X-axis, and exit the device via an exit aperture 24 in the conical electrode. If the position x of an ion on the X-axis is defined as the distance of the ion from the exit aperture 24, and the distance between the entrance and exit apertures 23,24, is $x_T$, then it can be shown that the potential at any point x on the X-axis within the ion storage device satisfies equation 2 above, and that the equipotentials in the field region between the opposed electrode surfaces lie on respective hyperboloid surfaces having rotational symmetry about the X-axis.

The entrance and exit apertures 23,24 for the ions are located on the X-axis at respective positions corresponding to $P_1$ and $P_2$ in FIG. 2, the latter being the time focal point for ions introduced into the device. During each ion storage period, the downstream electrode 22 will be maintained at the retarding voltage $V_o$ with respect to the upstream electrode 21. To that end, the upstream electrode 21 could be maintained at earth potential and the retarding voltage $V_o$ would be applied to the downstream electrode 22 during each ion storage period. However, in an alternative mode of operation, the downstream electrode could be maintained at the retarding voltage $V_o$ and the voltage on the upstream electrode would be pulsed up to the voltage $V_o$ so as to create a field free region between the electrodes during each listening period.

In practice, the flight path through the ion storage device could be 0.5 m or more in length, and so the two electrodes 21,22 would need to be prohibitively large.

With the aim of reducing the physical size of the ion storage device, the single hyperboloid electrode 21, in the electrode structure of FIG. 3(*a*), is replaced by a plurality of such electrodes $21^1$, $21^2 \ldots 21^n$ spaced apart at intervals along the X-axis, as shown in the transverse cross-sectional view of FIG. 3(*b*).

Each hyperboloid electrode lies on a respective equipotential surface ($Q_1 Q_2 \ldots Q_n$) and is maintained at the retarding voltage for that equipotential during each ion storage period. As before, the downstream electrode 22 has a conical electrode surface which is maintained at the retarding voltage $V_o$, and each electrode has a respective aperture, located on the X-axis, enabling the ions to travel through the device. The electrodes $21^1$, $21^2 \ldots 21^n$, 22 are dimensioned so as to occupy a cylindrical region of space, bounded by the broken lines shown in FIG. 3(*b*), giving the ion storage device a more compact structure on the transverse Y-Z plane.

Since the ions do not undergo any electrostatic retardation during the listening period, ions should preferably not enter the defined region R during that period. Accordingly, an electrostatic deflection arrangement comprising a pair of electrode plates 27,27', disposed to either side of path P, is provided. The electrode plates are energised during each listening period so as to deflect ions away from path P and prevent them from entering region R. To reduce the effect of fringing fields at the entrance aperture to the device, the deflection arrangement 27,27' is preferably energised a short time before the start of each new listening period.

In order that a sufficient number of ions may enter region R, it is desirable that each ion-storage period should be of sufficient duration to allow ions having the smallest mass-to-charge ratio of interest, $r_s = (m/q)_s$ to travel a maximum distance d into region R. For a typical application the distance d might be about 0.7 $x_T$.

It can be shown that the time $t_s$ required for an ion having the mass-to-charge ratio $r_s$ to travel said distance d during an ion-storage period (when the electrostatic retarding field is being applied) is given by the expression $$t_s = (K)^{\frac{1}{2}} \ln\left(1 - \frac{d}{x_T}\right),$$

where $$K = \frac{r_s x_T^2}{2V_o}$$

The listening period should also be of sufficient duration to enable ions having the largest mass-to-charge ratio of interest $r_1 = (m/q)_1$ to exit the defined region R. Since a heavy ion may only just have entered region R at the moment when the field generator is de-energised, the listening period should be long enough to allow that ion to traverse the region R, a distance $x_T$.

Applying equation 1, the velocity of a heavy ion on entry into region R would be $$\left(\frac{2V_o}{r_1}\right)^{\frac{1}{2}}$$

and so the minimum listening period $t_1$ would need to be $$t_1 = x_T\left(\frac{2V_o}{r_1}\right)^{\frac{1}{2}}$$

Accordingly, the ratio of the ion-storage period to the listening period should ideally be $$\left(\frac{r_s}{r_1}\right)^{\frac{1}{2}} \ln\left[1 - \frac{d}{x_T}\right]$$

Thus, if d is chosen to be 0.7 $x_T$ and the mass ratio of the heaviest to the lightest ions of interest is 10, the duty cycle would be 27.5%; that is to say, 27.5% of the total number of ions in the source beam would be subjected to the retarding field and available for analysis, whereas if the mass ratio is 100, the duty cycle would be 10.7%. This represents a substantial improvement over hitherto known ion storage devices employing continuous ion beams.

Alternatively, the duration of the ion-storage period may be set to discriminate in favour of detecting ions having particular masses. Thus, if it is desired to detect relatively heavy ions in preference to lighter ions, the ion storage period could be of relatively long duration.

An ion-storage device, as described, is particularly advantageous in that the stored ions are relatively free from space-charge effects and do not suffer any delay due to 'turn-around' time. A further advantage results from the fact that ions are not timed through any source extraction or focussing optics.

As has been explained, ions which are of interest need not in practice travel the maximum distance $x_T$ while the electrostatic retarding field is being applied during each ion storage period, and typically such ions might only travel a distance of about 0.7 $x_T$.

Accordingly, the electrostatic retarding field need not be applied over a corresponding downstream section of the defined region R, and so the downstream electrode 22 and one or more of the downstream hyperboloid electrodes (e.g. $\mathbf{21}^n$, $\mathbf{21}^{n-1}$) could be omitted from the electrode structure shown in FIG. 3(*b*).

Ions entering the ion storage device will still be brought to a time focus at the position on path P that would have been occupied by the exit aperture in electrode 22, corresponding to the position $P_2$ in FIG. 2; however, the ions will exit the electrode structure at a position upstream of the time focal point via the aperture in the hyperboloid electrode at the downstream end of the electrode structure. The time focal point can be arranged to lie within the dissociation region 30 close to the entrance to the ion mirror of the second time-of-flight device 40. However, because the ion storage device has a much reduced length more space is available to install ancillary deflector plates (to be described) between the two time-of-flight devices 20,40.

In effect, ions having the same mass-to-charge ratio will all arrive at the dissociation region 30 as a short burst or pulse (typically of 1-10 nsec duration) and the laser pulse generated in the dissociation region is timed to coincide with the arrival of the desired ions having a pre-selected mass-to-charge ratio. Such ions undergo dissociation in the dissociation region and the resulting daughter ions, and any undissociated parent ions, then enter the second time-of-flight device 40. This comprises a special form of ion mirror, described in our copending European patent application, Publication No. 408,288A1. This form of ion mirror has the property that the flight time of an ion through the ion mirror depends on its mass-to-charge ratio, but is entirely independent of its energy.

Figure 4:
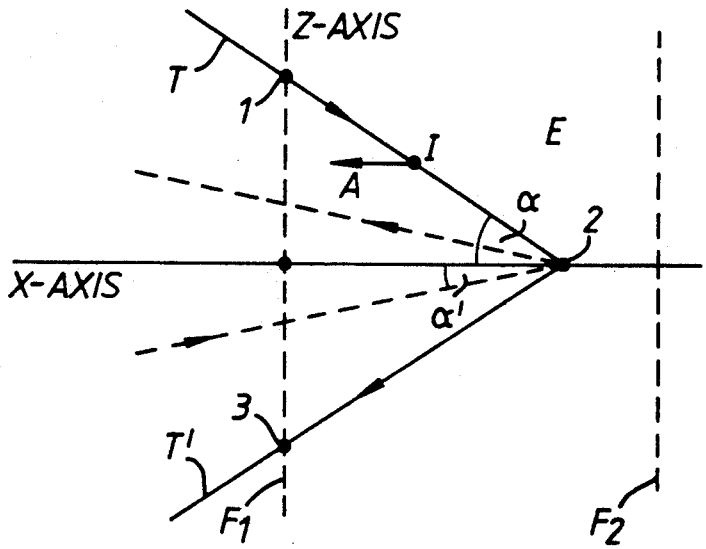
FIG. 4 is a diagrammatic illustration of an ion mirror used in the system of FIG. 1.

FIG. 4 illustrates diagrammatically how the ion mirror affects the motion of an ion I as it moves in the X-Z plane along a path T inclined at an angle of incidence $\alpha$ to the longitudinal X-axis. As will be explained the angle of incidence $\alpha$ can be controlled by electrostatic deflector plates positioned at the entrance to the ion mirror.

It will be assumed, for clarity of illustration, that the ion mirror establishes an electrostatic field region E bounded by the broken lines $F_1$,$F_2$ and that the ion I of mass-to-charge ratio (m/q), say, moving on path T enters the field region at a point 1, undergoes a reflection at a point 2 (having momentarily come to rest), returns on path T' and finally exits the field region at a point 3. In this illustration, paths T,T' lie in the X-Z plane and the ion I is reflected about the X-Y plane, normal to the plane of the paper.

The ion is subjected to an electrostatic reflecting force F which increases linearly as a function of the depth of penetration of the ion into the field region E. This force acts in the direction of arrow A in FIG. 4 and has a magnitude directly proportional to the separation x of the ion from the line joining the exit and entry points 1,3.

The electrostatic reflecting force F can be expressed as $$F = -kqx, \tag{5}$$

where k is a constant.

The equation of motion of the ion in the field region is akin to that associated with damped simple harmonic motion, and it can be shown that the time interval $t_r$ during which the ion travels from the point of entry 1 to the point of reflection 2 is given by the expression $$t_r = \frac{\pi}{2}\left(\frac{m}{q}\cdot\frac{l}{k}\right)^{\frac{1}{2}} \tag{6}$$

Thus, the ion occupies the field region for a total time interval $t'_r$ given by $$t_r' = 2t_r = \pi\left(\frac{m}{q}\cdot\frac{l}{k}\right)^{\frac{1}{2}} \tag{7}$$

As this result shows, the ion occupies the field region E for a time interval which depends only on its mass-to-charge ratio (m/q), and this enables ions to be distinguished from one another as a function of their mass-to-charge ratios, even if, as in the present case, they have different energies.

It has also been found that the flight times of ions through the ion mirror are substantially independent of angular deviation in the X-Y plane over a relatively small angular range (for example $\pm 1^o$) as measured by a flat plate detector the centre of which lies along the Y-axis.

Figure 5:
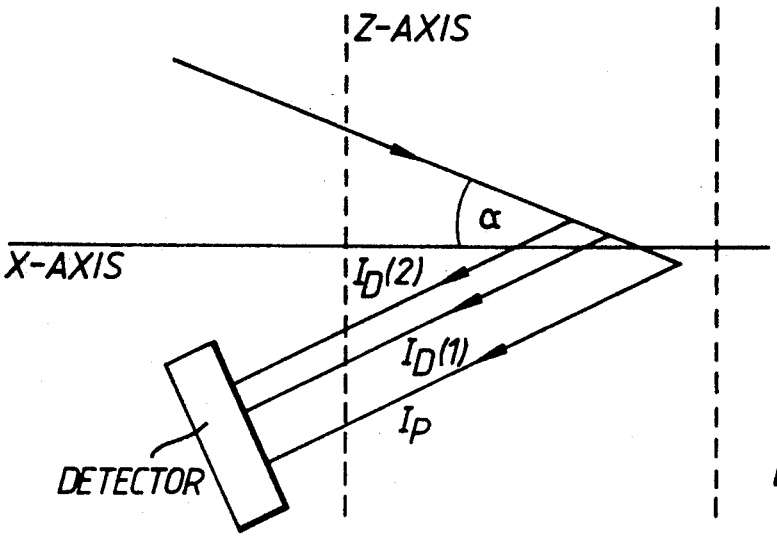
FIG. 5 illustrates the flight paths, through the ion mirror of FIG. 4, of undissociated parent ions and two daughter ions having different mass-to-charge ratios.

FIG. 5 shows, by way of example, the flight paths followed by undissociated parent ions $I_P$ and by two daughter ions $I_D(1)$,$I_D(2)$ having masses $M_D(1)$, $M_D(2)$ respectively, wherein $M_D(1) > M_D(2)$—it will be assumed, in this example, that the ions all have the same charge.

The undissociated parent ions $I_P$, being the heaviest, have the longest flight time through the field region and they move along the outermost path, whereas the lighter daughter ions $I_D(2)$ have the shortest flight time and because they have lower energy they follow the innermost path.

Ions having different mass-to-charge ratios are detected separately by measuring their different arrival times at a suitable detector, such as a multi-channel plate detector, thereby to produce a mass spectrum of the ions. However, since, in general, the undissociated parent ions will be much more energetic than the daughter ions the spatial spread in the Z-axis direction of the ions received at the detector could be considerable. As already mentioned, electrostatic deflector plates can be used to control the angle of incidence $\alpha$ of ions entering the ion mirror and one particular function of the deflector plates is to reduce the spatial spread of ions at the detector. In this example, ions that are of interest are caused to enter the ion mirror at a positive angle of incidence (as shown) enabling them to be reflected towards the detector. To that end, the deflector plates subject all the ions to an electrostatic deflecting force (in the downwards Z-direction in FIG. 4) just before they enter the field region of the ion mirror. However, as explained, the relatively light daughter ions have lower energies than the heavier, undissociated parent ions and so they suffer a comparatively large deflection, increasing their angles of incidence $\alpha$ relative to that of the parent ions and this has the effect of reducing the spatial spread of the ions received at the detector.

An ion mirror, as described, uses an electrostatic reflecting field in the form of an electrostatic quadrupole field. The ion mirror could have a "three-dimensional" electrode structure similar to that for the ion storage device described with reference to FIGS. 3(*a*) and 3(*b*), but with the voltages reversed. However, an ion mirror having a rotationally symmetric electrode structure has the disadvantage that ions would be reflected back along the same path, necessitating an annular detector. A "two-dimensional" electrode structure is therefore preferred.

Adopting the Cartesian co-ordinate system of FIG. 1, the distribution (in two dimensions) of electrostatic potential V(x,y) in the electrostatic quadrupole field satisfies the condition $$V(x,y) = \frac{V_o}{r_o^2}(x^2 - y^2) \tag{8}$$

where $V_o$ is a constant and x,y are the X,Y position co-ordinates in the field region.

An electrostatic field of this form has four-fold symmetry about the Z-axis and could be generated by a quadrupole electrode structure (which provides field in all four quadrants) or a monopole electrode structure (which provides field in only one of the quadrants).

Figure 6A:
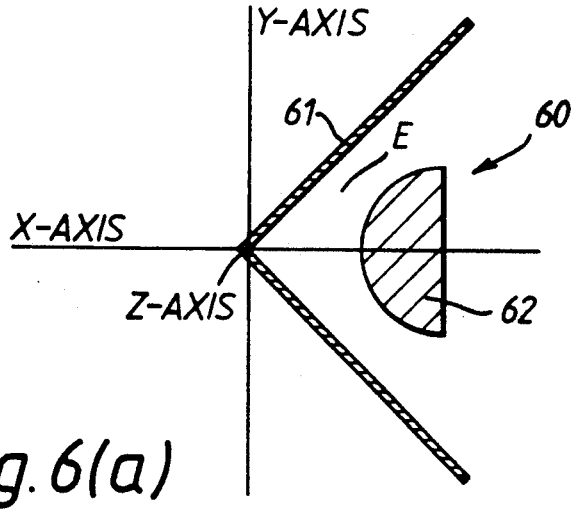
FIGS. 6(*a*) and 6(*b*) show a transverse, cross-sectional view and a perspective view respectively of an ion mirror having a monopole electrode structure.
Figure 6B:
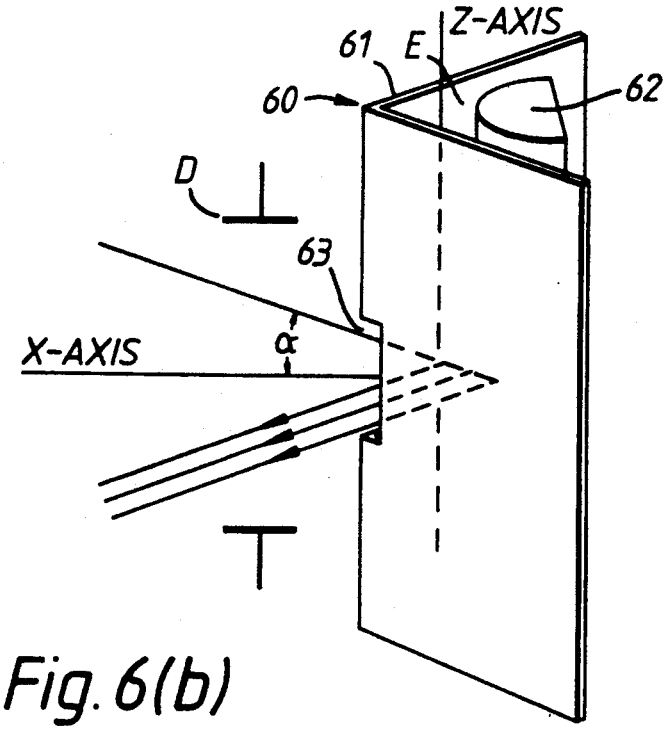

FIGS. 6*a* and 6*b* show a "two-dimensional" monopole electrode structure.

The monopole electrode structure 60, shown in these Figures, comprises two elongate electrodes 61,62 which extend parallel to the Z-axis of the electrode structure, and are spaced apart from each other along the longitudinal X-axis.

The two electrodes have inwardly facing electrode surfaces which are disposed symmetrically with respect to the X-Z plane and define an intermediate field region E.

Electrode 61 has a substantially V-shaped transverse cross-section (subtending an angle of 90°) whereas electrode 62 is in the form of a rod and has a hyperbolic or, alternatively, a circular transverse cross-section.

The deflector plates for controlling the angles of incidence of the ions are shown at D in FIG. 6*b*. As shown in FIG. 6*b*, electrode 61 has an elongate window 63 by which the ions can enter the field region for reflection in the X-Z plane, one of the electrodes being maintained at a fixed d.c. voltage with respect to the other electrode. If, for example, electrode 62 is maintained at a positive d.c. voltage with respect to electrode 61, the electrostatic field created in the field region would be such as to reflect positively-charged ions. Conversely, if electrode 62 is maintained at a negative d.c. voltage with respect to electrode 61, the electrostatic field would be such as to reflect negatively-charged ions.

Figure 7A:
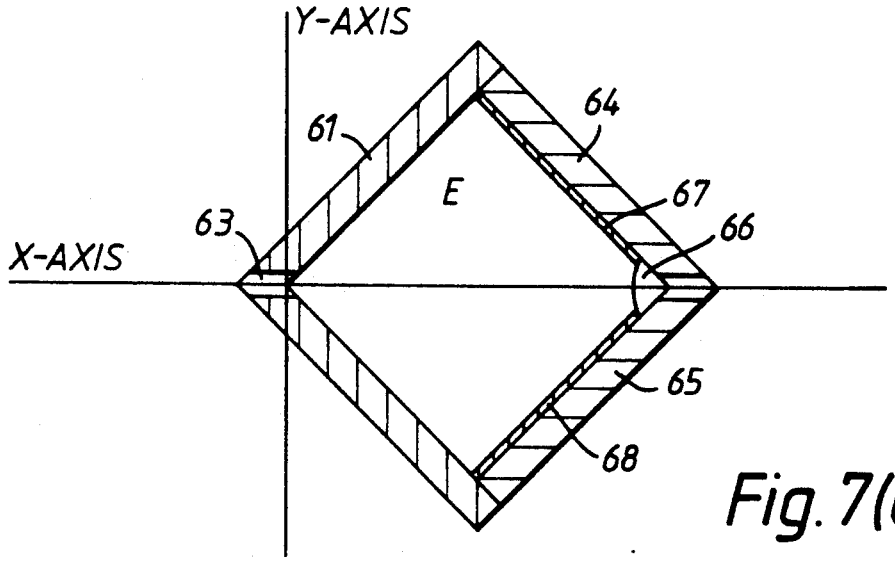
FIG. 7(*a*) shows a transverse, cross-sectional view through an ion mirror having a different monopole electrode structure.

FIG. 7*a* shows a transverse cross-sectional view through an alternative monopole electrode structure. This electrode structure has a pair of orthogonally inclined side walls 64,65 made from an electrically insulating material, such as glass. The side walls abut the electrode 61, as shown, to form a boundary structure enclosing a field region E of square cross-section. An electrode 66, positioned at the apex of the side walls, is maintained at an appropriate d.c. retarding voltage with respect to the electrode 61, and the side walls bear respective coatings 67,68 of an electrically resistive material inter-connecting electrodes 61 and 66. The structure may also have coated end walls (not shown) which serve to terminate electrostatic field lines extending in the Z-axis direction and so, in effect, simulate a structure having infinite length in that direction.

Figure 7B:
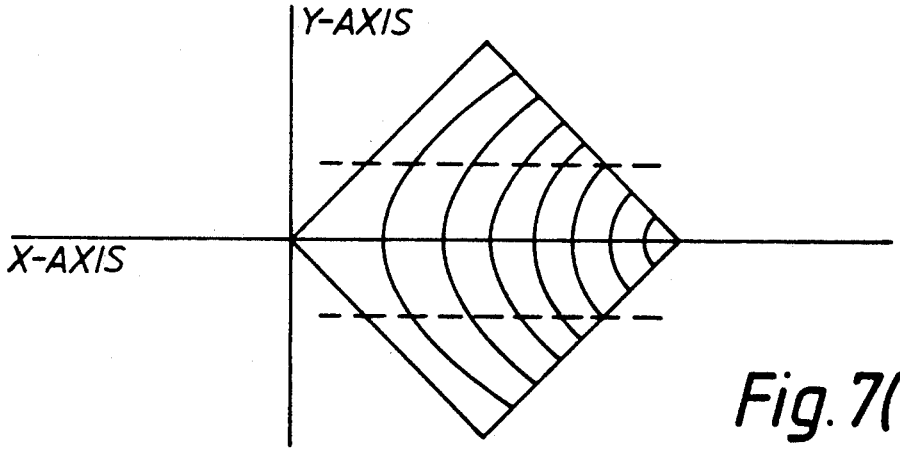

The quadrupole electrostatic field created by the "two-dimensional" electrode structures described with reference to FIGS. 6 and 7 have hyperbolic equipotential lines in the transverse X-Y plane, as defined by equation 8 above, and the equipotentials lie on respective surfaces extending parallel to the Z-axis. The equipotential lines for the structure shown in FIG. 7*a*, are illustrated in FIG. 7*b*. The voltage varies linearly along the side walls, in the transverse direction, from the voltage value at electrode 66 to the voltage value at electrode 61. The coatings 67,68 should, therefore, ideally be of uniform thickness. However, such coatings may be difficult to deposit in practice.

Figure 7C:
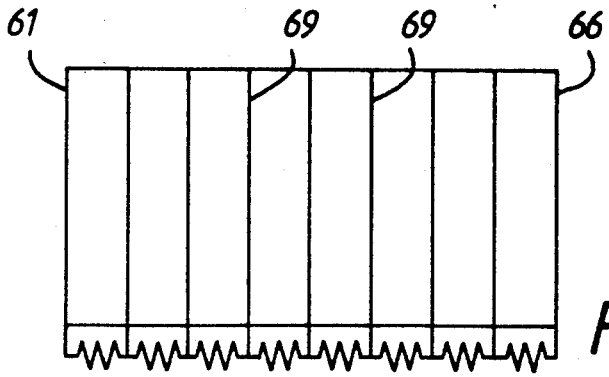

In an alternative embodiment, the coatings are replaced by discrete electrodes 69 provided on the side and/or end walls along the lines of intersection with selected equipotentials. Each such electrode 69 is maintained at a respective voltage intermediate that at electrode 66 and that at electrode 61. Since the voltage must vary linearly along each side wall, the electrodes provided thereon lie on parallel, equally-spaced lines, as shown in FIG. 7*c*, and the required voltages may then be generated by connecting the electrodes together in series between electrodes 61 and 66 by means of resistors having equal resistance values.

The corresponding electrodes on the end walls would lie on hyperbolic lines, as illustrated in FIG. 7*b*.

Figure 3B:
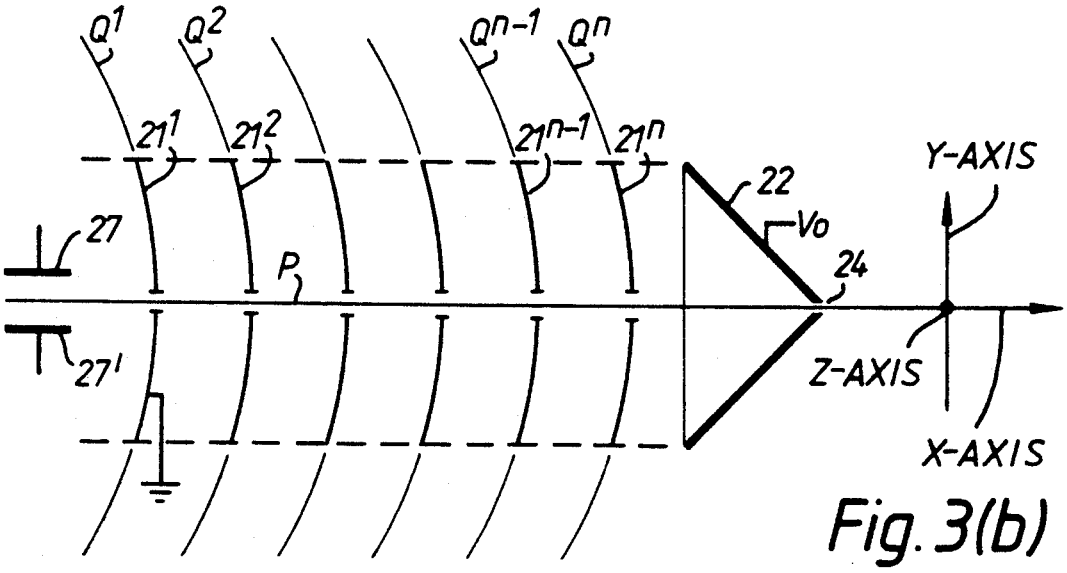
Figure 8A:
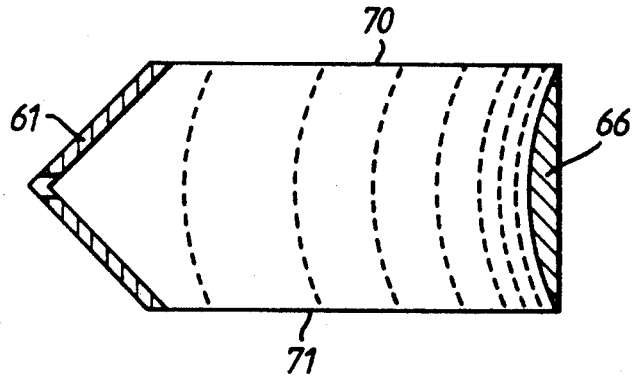
FIG. 8(*a*) shows a transverse cross-sectional view through a yet further ion mirror having a monopole electrode structure.

FIG. 8*a* shows a transverse cross-sectional view through another "two-dimensional" monopole electrode structure which is analogous to the "three-dimensional" electrode structure described with reference to FIG. 3*b*.

In this case, the discrete electrodes 69 lie in parallel planes defining the sides 70,71 of the structure. This gives a more compact structure in the transverse (Y-axis) direction. The parallel planes are represented by the broken lines in FIG. 7(*b*). It will be clear from that Figure that the electrostatic potential varies in non-linear fashion along each side 70,71, and so the discrete electrodes would be spaced progressively closer together in the direction approaching electrode 66. As before, discrete electrodes may also be provided at the ends of the structure, and each such electrode would conform to a respective hyperbolic equipotential line having the form shown in FIGS. 7(*b*).

Figure 8B:
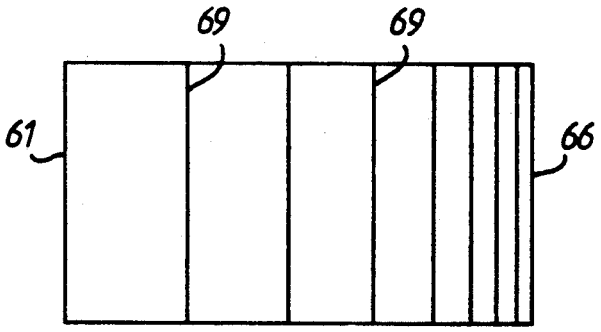

It will be appreciated that the ion storage device 20 could have the same general structure as that shown in FIGS. 6 to 8 for the ion mirror, but operating in reverse, and having entrance and exit apertures at opposite ends of the device. Furthermore, in regard to the embodiments shown in FIGS. 7 and 8, the ion storage device could have a series of apertured electrode plates, each having a hyperbolic transverse cross-section (in the X-Y plane) and extending parallel to the Z-axis direction, in place of electrodes 69 applied to the side walls of those structures, and "three-dimensional" versions of the FIG. 7 and 8 structures would also be feasible. Also, in the case of "three-dimensional" electrode structures the conical section electrode and optionally one or more of the discrete downstream electrodes could be omitted.

It is, of course, possible to use any combination of the "two-dimensional" and "three-dimensional" electrode structures for the ion mirror and the ion storage device. However, for the ion mirror a "two-dimensional" electrode structure is preferred, as already explained.

As already explained, a laser pulse is used to dissociate parent ions having the selected mass-to-charge ratio. The laser pulse is timed to coincide with arrival of the desired ions at the dissociation region 30, and the resulting daughter ions, and any undissociated parent ions, then enter the ion mirror for mass analysis. By varying the timing of the laser pulses, applied during successive operating cycle of the system, it is possible to investigate the daughter ion spectra of different, selected parent ions within a given range of mass-to-charge ratio determined by the operating conditions of the ion storage device, as described hereinbefore.

During each operating cycle, ions having mass-to-charge ratios smaller than that selected by the timing of the laser pulse, which do not undergo dissociation, enter the ion mirror ahead of the desired ions. Similarly, ions having larger mass-to-charge ratios will enter the ion mirror after the desired ions. Since these relatively light and relatively heavy ions are of no intrinsic interest, at least for the current operating cycle, their detection is not required and so they are deflected away from the detector. To that end, the polarities applied to the deflector plates at the entrance to the ion mirror are reversed, causing the unwanted ions to enter the ion mirror at a negative angle of incidence $\alpha'$ and to be deflected away from the detector—the trajectory of such ions is represented by the broken line in FIG. 4.

Alternatively, the relatively heavy ions may be detected by the detector of the ion mirror, or it may be preferred to sweep these ions from the ion storage device before they enter the ion mirror so that the next ion storage period can commence earlier than would otherwise have been the case. In the case of a "three-dimensional" electrode structure this could be achieved using several split hyperboloid electrodes, for example, enabling a transverse electrostatic sweep field to be generated between the split parts. Similar arrangements are possible for the "two-dimensional" electrode structures also. However, since, in general, ions spend considerably longer in the ion mirror than in the ion storage device, the resulting improvement in duty cycle may not be very significant.

The mass spectrometry system described with reference to the drawings finds particular (though not exclusive) application in the structural analysis of large molecules contained in biological and biochemical samples, for example. Because the ion storage device may have a relatively high duty cycle the system is well suited to process small sample volumes delivered by conventional inlet systems, such as a liquid chromatograph, for example. Furthermore, because the flight times of ions through the ion mirror of the described system depend on the mass-to-charge ratios of the ions, and are entirely independent of their energies, a relatively high mass resolving power can be attained. It is also possible to achieve very short analysis times.

It will be understood that the present invention is not limited to the particular forms of time-of-flight device described with reference to the drawings. Furthermore, in a further application of the invention, the mass-separated ions exiting the first time-of-flight device (which may be an ion storage device of the kind described in the drawings) are introduced directly into the second time-of-flight device (which may be an ion mirror of the kind described) for analysis, without being dissociated.

In this way, all the mass-separated ions accumulated during each ion storage Period can be analysed with improved resolution.

We claim:

1. A mass spectrometry system comprising a source of ions for analysis, a first time-of-flight means for separating the source ions according to their mass-to-charge ratios, and a second time-of-flight means for analysing the mass-to-charge ratios of source ions which exit the first time-of-flight means and/or daughter ions derived from such source ions, wherein the first time-of-flight means is an ion storage device comprising field generating means for subjecting the source ions to an electrostatic retarding field during an initial part only of a preset time interval, the electrostatic retarding field having a spatial variation such that source ions which have the same mass-to-charge ratio and enter the ion storage device at different times during said initial part of the preset time interval are all brought to a time focus during the remaining part of that preset time interval.

2. A mass spectrometry system as claimed in claim 1, comprising means for dissociating separated source ions having a selected mass-to-charge ratio whereby to generate said daughter ions.

3. A mass spectrometry system as claimed in claim 1, wherein the spatial variation of the electrostatic retarding field is such that the velocity of each ion during said initial part of the preset time interval is linearly related to its separation from the point at which the ions are brought to the time focus.

4. A mass spectrometry system as claimed in claim 1, wherein the field generating means periodically subjects source ions to the electrostatic retarding field during the respective initial parts of successive said time intervals.

5. A mass spectrometry system as claimed in claim 1, wherein the electrostatic retarding field is an electrostatic quadrupole field.

6. A mass spectrometry system as claimed in claim 5, wherein the field generating means comprises an electrode structure having rotational symmetry about the longitudinal axis of the ion storage device.

7. A mass spectrometry system as claimed in claim 6, wherein the electrode structure comprises a first electrode having a spherical or hyperboloid electrode surface and a second electrode having a conical electrode surface facing the electrode surface of the first electrode, wherein the second electrode is maintained at a retarding voltage with respect to the first electrode during said initial part of the or each preset time interval and has an exit aperture by which ions can exit the ion storage device, and the first electrode has an entrance aperture by which the ions can enter the ion storage device.

8. A mass spectrometry system as claimed in claim 7, wherein the retarding voltage is such that the ions are brought to said time focus at the exit aperture of the second electrode.

9. A mass spectrometry system as claimed in claim 6, wherein the electrode structure comprises a plurality of electrodes spaced at intervals along the longitudinal axis of the ion storage device, each electrode in the plurality substantially conforming to a respective equipotential surface in the electrostatic quadrupole field and being maintained at a respective retarding voltage during the initial part of the or each said preset time interval, and having a respective aperture enabling the ions to travel through the ion storage device.

10. A mass spectrometry system as claimed in claim 9, wherein the electrode structure comprises a further electrode having a conical electrode surface, the further electrode having an exit aperture by which ions can exit the ion storage device and being maintained at a retarding voltage during the initial part of the or each said preset time interval.

11. A mass spectrometry system as claimed in claim 10, wherein the respective retarding voltages on the electrodes are such that the ions are brought to a time focus at the exit aperture of the further electrode.

12. A mass spectrometry system as claimed in claim 1, wherein the electrodes occupy a cylindrical region of space around the longitudinal axis of the ion storage device.

13. A mass spectrometry system as claimed in claim 1, wherein the second time-of-flight means comprises an ion mirror.

14. A mass spectrometry system as claimed in claim 13, wherein the ion mirror subjects ions to an electrostatic reflecting field in the form of an electrostatic quadrupole field whereby the flight time of each ion through the ion mirror depends on the mass-to-charge ratio of that ion and is independent of the energy of the ion.

15. A mass spectrometry system as claimed in claim 14, including means for controlling the trajectories of ions entering the ion mirror.

16. A mass spectrometry system as claimed in claim 13, wherein the ion mirror comprises a monopole electrode structure operating at a d.c. voltage.

17. A mass spectrometry system as claimed in claim 16, wherein the monopole electrode structure comprises a first electrode having an electrode surface of substantially V-shaped transverse cross-section and a second electrode which is maintained, in operation, at a d.c. retarding voltage with respect to the first electrode, the first electrode having an aperture or apertures by which ions an enter and exit the electrostatic reflecting field between the first and second electrodes.

18. A mass spectrometry system as claimed in claim 17, including a flat plate detector arranged transversely with respect to the first electrode.

19. A mass spectrometry system as claimed in claim 1, including means to remove from the ion storage device any source ion having a mass-to-charge ratio greater than a selected mass-to-charge ratio.

20. A mass spectrometry system comprising a source of ions for analysis, a first time-of-flight means for separating the source ions according to their mass-to-charge ratios, a second time-of-flight means for analysing the mass-to-charge ratios of source ions which exit the first time-of-flight means and/or daughter ions derived from such source ions, the second time-of-flight means comprising an ion mirror for subjecting ions to an electrostatic reflecting field in the form of an electrostatic quadrupole field whereby the flight times of ions through the ion mirror depend on their mass-to-charge ratios and are independent of their energies, and control means for controlling the trajectories of ions entering the ion mirror, wherein the electrostatic reflecting field reflects ions that are to be analysed toward a detector and the control means controls the spatial separation of the ions detected by the detector.

21. A mass spectrometry system as claimed in claim 20, wherein the control means causes ions that are not to be analysed to be reflected away from the detector by the electrostatic reflecting field.

22. A mass spectrometry system as claimed in claim 21, wherein the control means causes ions that are to be analysed to have angles of incidence of one sign relative to the longitudinal axis of the ion mirror and ions that are not to be analysed to have angles of incidence of the opposite sign relative to the longitudinal axis of the ion mirror.

* * * * *